United States Patent [19]

Summa

[11] Patent Number: 5,033,394

[45] Date of Patent: Jul. 23, 1991

[54] FLOOR CONVEYOR JUNCTION SEAL GAP CLOSURE

[75] Inventor: Gareth D. Summa, Riverside, Mo.

[73] Assignee: Mid-West Conveyor Company, Inc., Kansas City, Kans.

[21] Appl. No.: 417,912

[22] Filed: Oct. 6, 1989

[51] Int. Cl.[5] ..... B61B 12/00

[52] U.S. Cl. ..... 104/307; 104/106; 104/130

[58] Field of Search ..... 104/96, 100, 102, 103, 104/104, 106, 130, 140, 141, 172.2, 307, 172.3

[56] References Cited

U.S. PATENT DOCUMENTS

| | | | |
|---|---|---|---|
| 3,406,638 | 10/1968 | Braun | 104/172.2 |
| 3,418,944 | 12/1968 | Hansford et al. | 104/130 |
| 3,418,945 | 12/1968 | Stevenson et al. | 104/172.2 |
| 3,426,701 | 2/1969 | Braun | 104/172.2 |
| 3,769,915 | 11/1973 | Swartz | 104/88 |
| 4,089,270 | 5/1978 | Blake | 104/130 |
| 4,790,247 | 12/1988 | Summa | 104/172.2 |

FOREIGN PATENT DOCUMENTS

| | | | |
|---|---|---|---|
| 1232220 | 4/1959 | France | 104/96 |

*Primary Examiner*—Robert J. Oberleitner
*Assistant Examiner*—S. Joseph Morano
*Attorney, Agent, or Firm*—Litman, McMahon & Brown

[57] ABSTRACT

A floor conveyor junction seal gap closure includes a closure member pivotally mounted on and resiliently connected to a bracket extending upward from a conveyor switch mechanism. The floor conveyor includes a main line and a diverging branch line, both adapted to carry load trolleys connected by posts to load carriers positioned above the floor level. Floor slots are provided to clear the connection posts, and the slots are closed by split resilient seals. The seals are opened by the connection posts moving through them and resiliently close behind the posts. A seal gap is formed at the area of divergence of the branch slot from the main slot. The closure plate is positioned below the seal gap to normally close the seal gap. The resilient mounting of the closure plate allows it to be deflected to allow a connection post to pass through the seal gap and afterward returns the closure plate to its neutral position to close the seal gap.

20 Claims, 3 Drawing Sheets

Fig.6.
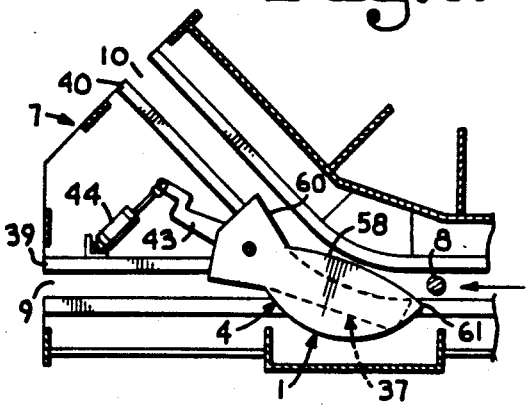
Fig.7.
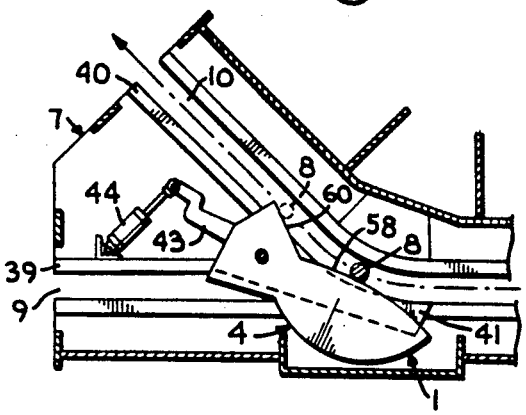
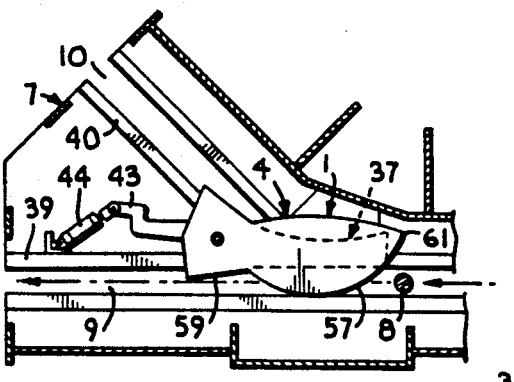
Fig.8.
Fig.9.
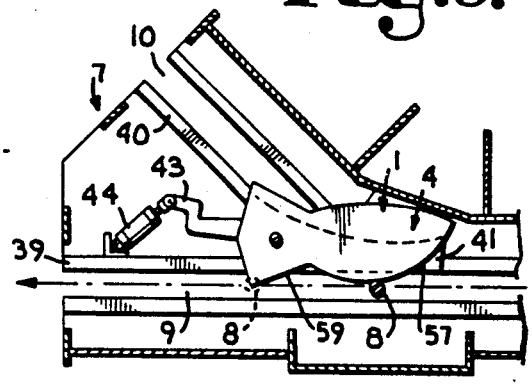
Fig.10.
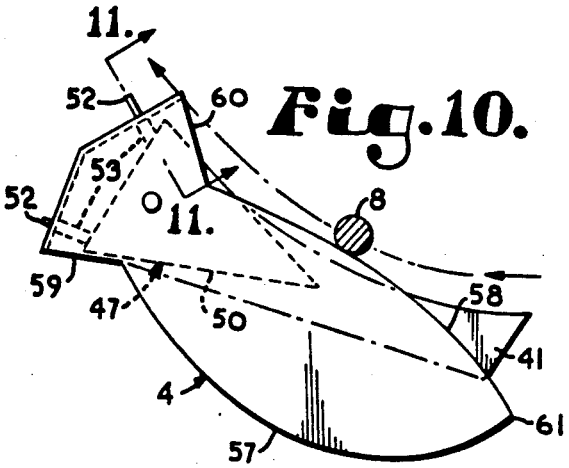
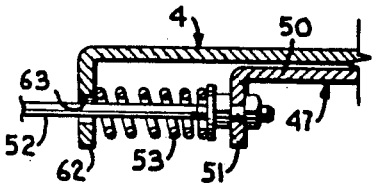
Fig.11.

FLOOR CONVEYOR JUNCTION SEAL GAP CLOSURE

FIELD OF THE INVENTION

The present invention relates to inverted power and free conveyors and, more particularly, to a safety closure for a gap in seals extending along floor openings for such conveyors at junctions of branch lines with main lines.

BACKGROUND OF THE INVENTION

An inverted power and free conveyor typically consists of a power track guiding power trolleys supporting a continuously driven power chain, a load track guiding load trolleys, and a load connected to the load trolleys and supporting loads to be conveyed. Each load trolley has a retractable load dog which is selectively engaged with one of a plurality of power dogs spaced along the power chain for powered movement of a load on a load trolley. Alternatively, the load dog can be retracted to brake a load carrier or for manually positioning the carrier. Inverted power and free conveyors find wide application in manufacturing industries, such as automotive assembly lines and the like.

Such conveyors are often installed with at least some sections having their components mounted below a floor level with only the load carrier and connection members or posts connected to corresponding load trolleys extending above the floor level through a long narrow opening or slot in the floor. In order to reduce contamination of the conveyor components from dust and other foreign matter, it is a common practice to close the floor slot with a longitudinally split resilient seal. As a load carrier moves along such a submerged conveyor section, the connection members, also referred to as seal separator pins, open the seal which then closes behind the connection members, somewhat in the manner of a zipper.

A problem with such split seals occurs at a junction of a main line or track of the conveyor with a branch or spur line. At a junction of a submerged inverted power and free conveyor, a slot for the branch line diverges from the main slot. One of the split seal members of the main line continues along an outer side of the main line, relative to the junction, while the other follows the branch line and becomes an outer seal member therefor. A new inner main seal member begins at the junction, as does an inner branch seal member. The problem arises as a result of the greater span across the area where the branch slot diverges from the main slot.

While it would be possible to extend portions of the inner branch and main seal members to cover the area of divergence of the slots, practical considerations rule out this solution. Such extended seal portions, or even a specially configured junction seal member, would be pointed in a direction counter to oncoming carrier connection members, the point being positioned on the centerline interface between the seal members of the main line. As a result, such pointed seal extensions or special seal member would quickly be damaged by the connection members. Additionally, the seal members must be resilient enough to allow splitting by the carrier connection members travelling therealong but stiff enough to prevent penetration by a worker walking over the seals or rolling the wheels of a cart, for example, thereover. This is easy enough to accomplish along the principal sections of the conveyor lines. However, in the divergence area at a junction, the increased span across the area of divergence and seals covering same would probably result in a "soft" spot, through which a workers foot or cart wheel might penetrate. This could result in serious injury to a worker or damage to a cart and/or a load being carried by the conveyor.

To avoid these problems, it is a common practice to leave the area of divergence of the slots open and to mark an area on the floor surrounding the seal gap with a highly visible warning in addition to verbally warning the workers as part of plant safety training. Despite such precautions, the existence of such a hazardous condition in a plant is likely to be disfavored by government industrial safety agencies and insurers of the plant, since an inattentive worker looking in the wrong direction while walking in the area of the seal gap might easily wedge a foot in the gap, with serious consequences.

What is needed is a mechanism which normally covers or closes the gap in the seal arrangement to prevent worker penetration and which does not interfere with the normal operation of the conveyor system.

SUMMARY OF THE INVENTION

The present invention provides a seal gap closure for a subfloor mounted inverted power and free conveyor which achieves those objectives. In a preferred embodiment, for use at a junction where a branch conveyor line diverges from a main line, a closure plate is mounted on a switch member which is pivoted between a main position to maintain load carriers on the main line and a branch position to switch carriers onto the branch line. The closure plate has a fish-like shape formed by opposite sets of deflecting cam surfaces or edges curving toward a forward point and straight return cam surfaces or edges diverging from the deflecting cam surfaces. A bracket is mounted on the switch member and extends upwardly therefrom. An upper plate on the bracket has the closure plate pivotally connected thereto with springs connected between the plates to urge the closure plate to a neutral position relative to the bracket plate. The closure plate is positioned immediately below the seal members and has an area sufficient to close the seal gap in the neutral position of the closure plate in either position of the switch member.

When the switch member is in the main position, the front point of the closure plate is on a branch or inner side of a centerline of the main conveyor line. A connection member approaching the conveyor junction engages a main deflecting cam surface and deflects the closure plate toward the branch side of the conveyor to allow passage of the connection member through the seal gap. The resilient connection of the closure plate to the bracket plate urges the closure plate back to its neutral position closing the seal gap. In order to positively return the closure plate to its closing position, a main return cam surface is provided for engagement by the connection member as it is moved past the junction area. When the switch member is in the branch or switch position, the front point of the closure plate is positioned on an outer side of the main conveyor centerline whereby engagement of the connection member of the load carrier with a branch deflecting cam surface deflects the closure plate away from the branch side of the junction and out of closing relation to the seal gap to allow the connection member to pass, and thereafter engagement of the connection member with a branch return cam surface returns the closure plate to its neutral position closing the seal gap.

At a merging or converging type of conveyor junction, where a branch line merges with the main line, a pointed configuration of the seal members to close the slot gap does not present the same range of problems as at a diverging junction, since such a point is directed in the direction of movement of the connection members and would, thus, not be subject to destruction thereby. However, such a seal formation might result in an undesirable flexibility in this area which might give way under the weight of a worker or equipment being moved thereover. Additionally, the use of specially shaped seal members might not be desirable. The seal gap closure of the present invention is adaptable for use in closing a seal gap occurring at a such a merging junction. A conveyor switch member is not required at such a merging junction, thus, some variations in the shape of the closure plate and the manner of mounting it, as compared with seal gap closure arrangement for a diverging junction, would be required. In general, a merging junction seal closure plate is resiliently and pivotally mounted in a fixed position, and the shape of the closure plate is altered in such a manner as to normally close the seal gap while presenting deflecting and return cap surfaces or edges to a load carrier connection member approaching from either the branch line or the main line.

OBJECTS OF THE INVENTION

The principal objects of the present invention are to provide an apparatus for enhancing the safety of operation of an inverted power and free conveyor mounted below a floor level; to provide such an apparatus which normally closes a seal gap formed at a junction of a main conveyor line and a branch line by resilient seal members of slots of the main and branch lines; to provide such a seal gap closure arrangement which yields to allow movement of load carriers of the conveyor system past a closure member of the arrangement and which returns to closing relation with the seal gap thereafter; to provide such an arrangement which is mounted on a conveyor switch mechanism which is pivoted between a main position to maintain load carriers on the main line and a branch or switch position which causes load carriers to exit the main line and transfer onto the main line; to provide such an arrangement in which pivoting the switch member properly positions the seal gap closure member for deflection by connection members of passing load carriers; to provide such an arrangement wherein a seal gap closure plate is pivotally and resiliently connected to a bracket mounted on the conveyor switch member for deflection by connection members of passing load carriers; to provide such an arrangement in which the closure plate is positively returned to its closing position by the passing connection members; to provide such an arrangement wherein the closure plate has a fish-like shape defined by opposite sets of curved deflection cam surfaces or edges and angularly diverging return surfaces or edges; to provide such an arrangement which is adaptable for closing a seal gap at either a junction formed by a branch line diverging from the main line or a junction formed by a branch line merging into the main line; and to provide such a seal gap closure arrangement which is economical to manufacture, effective and durable in operation, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification, include exemplary embodiments of the present invention, and illustrate various objects and features thereof.

BRIEF DESCRIPTION OF THE DRAWINGS

FIG. 6 is a diagrammatic top plan view of the junction area of the conveyor with the closure plate in a neutral position on the switch member which is in the branch or switch position thereof as a connection post approaches.

FIG. 7 is a view similar to FIG. 6 and illustrates the closure plate in a deflected position by engagement of a connection post of a load carrier which has been switched onto the branch line.

FIG. 8 is a view similar to FIG. 6 and illustrates the neutral position of the closure plate on the switch member in the main position as a connection post approaches.

FIG. 9 is a view similar to FIG. 6 and illustrates the closure plate in a deflected position by engagement of a connection post of a load carrier remaining on the main line in passing by the junction.

FIG. 10 is a diagrammatic top plan view at an enlarged scale of a seal gap closure plate in relation to a mounting bracket and a conveyor switch member.

FIG. 11 is a fragmentary sectional view taken along line 11—11 of FIG. 10 and illustrates details of the resilient connection of the closure plate to a bracket plate of the mounting bracket.

DETAILED DESCRIPTION OF THE INVENTION

Figure 1:
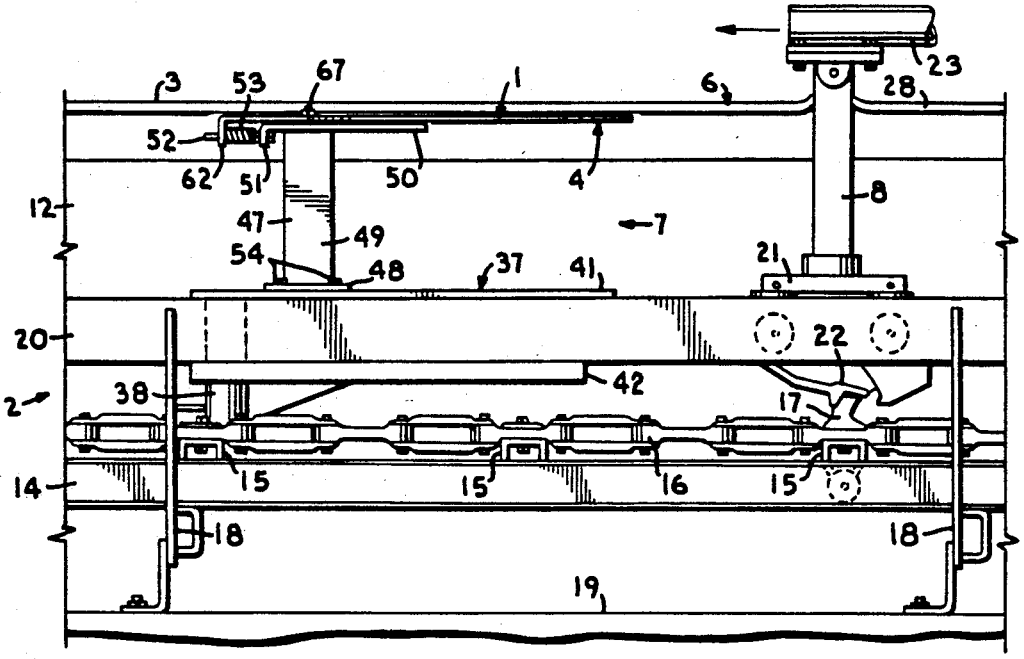
FIG. 1 is a fragmentary longitudinal sectional view through a main line of a branched inverted power and free conveyor mounted below a floor level and incorporating a seal gap closure arrangement embodying the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates a seal gap closure arrangement for an inverted power and free conveyor system 2 mounted below a level of a floor 3 and embodying the present invention. The arrangement 1 includes a closure member or plate 4 which normally closes a gap 5 (FIG. 3) occurring in a slot seal system 6 at a switch junction 7 of the conveyor system 2. The closure plate 4 is mounted in such a manner as to yield to allow movement of connection posts 8 associated with the conveyor system 2 past the plate 4 along a main line 9 or a branch line 10 of the conveyor system 2. The arrangement 1 prevents the penetration of the seal gap 5 by the foot of a worker or a wheel of a cart, for example, and injuries or property damage which might result therefrom and thereby enhances the safety of operation of the conveyor system 2 without interfering with the normal operation thereof.

Referring to FIG. 1, the conveyor system 2 is a flush subfloor inverted power and free type of conveyor system which is mounted below the floor level 3 within an elongated trench or pit 12. A power track 14, formed of inwardly facing channels, supports power trolleys 15 which, in turn, support a power chain 16. The chain 16 has power or chain pusher dogs 17 attached thereto at selected intervals. Conveyor frame members or yokes 18 support the power track 14 above a lower surface 19 of the pit 12. The yokes 18 support a load or free track 20, formed of inwardly facing channel members, above the power track 14. The free track 20 has load trolleys 21 with depending load dogs 22 running therealong. Load carriers 23 are supported above the load trolleys 21 and connected thereto by the connection posts 8, also referred to as seal splitter pins. The load carriers 23 may have additional framework (not shown) thereon for supporting and conveying loads, such as automotive chassis in an automotive assembly plant or the like. The load dogs 22 are pivotally connected to the load trolleys 21 and are controllable to selectively engage the pusher dogs 17 for powered movement or to retract from the pusher dogs 17 for braking, accumulation, or manual positioning of the load carriers 23. Additional details of the construction and operation of inverted power and free conveyors similar to the conveyor system 2 are available from U.S. Pat. No. 4,790,247, which is incorporated herein by reference.

The purposes for mounting conveyor system 2 in the pit 12 below the floor level 3 include simplifying the movement of materials and equipment across the conveyor lines, increasing plant productivity by positioning work assemblies at a level which is easier to access by workers and production machinery, conveyor noise reduction, safety, and the like. The upper side of the pit 12 is closed by structure such as top plates 25 (FIGS. 3-5) or similar structural members which can support the weight of workers walking thereon and the movement of carts, dollies, fork lifts, and the like thereover. The top plates 25 form elongated openings or floor slots 26 to clear the connection posts 8 connecting the load trolleys 21 with the load carriers 23. The slots 26 are normally closed by the seal system 6, to reduce contamination of and damage to components of the conveyor system 2 by dirt and other foreign objects or material, and as a safety measure, to prevent injury to the workers who might step into the slots 26.

The illustrated slot seal system 6 includes elongated seal members 28 and 29 in the main line slot 30 which are positioned in abutting relation across the slot 30. The seal members 28 and 29 are resilient to allow movement of the connection posts 8 therethrough by splitting therebetween. The seal members 28 and 29 close behind the post 8, somewhat in the manner of a zipper. While flexible, the seal members 28 and 29 are stiff enough to prevent penetration by the foot of a worker casually stepping thereon. In some installations, members of such a slot seal system 6 are angled upwardly toward the interface therebetween for even greater resistance to penetration from an upper side.

Figure 3:
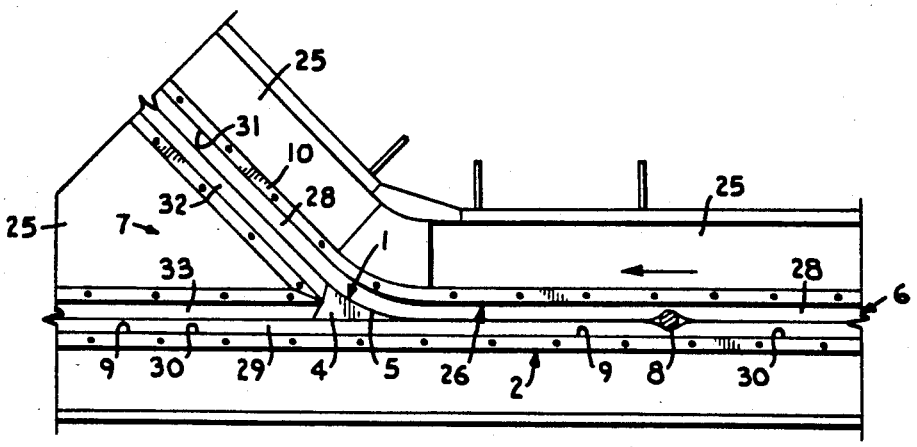
FIG. 3 is a fragmentary top plan view at a somewhat reduced scale of a junction of a submerged inverted power and free conveyor incorporating the seal gap closure arrangement and illustrating a connection post of a load carrier approaching the junction.
Figure 4:
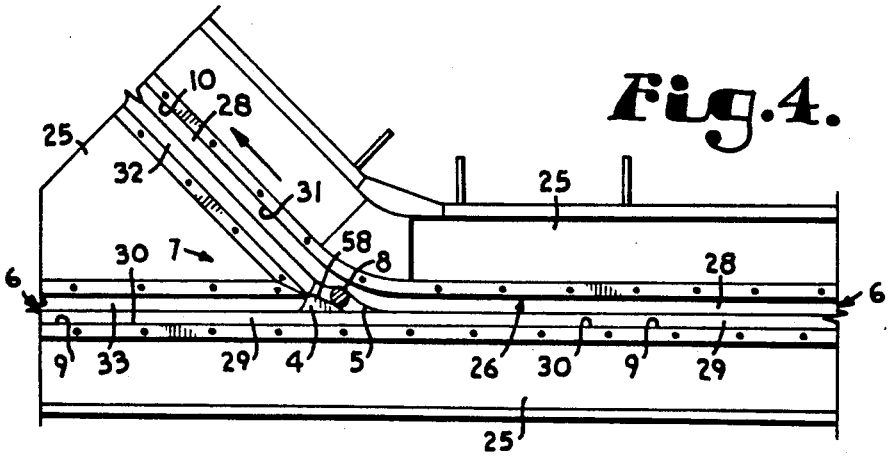
FIG. 4 is a view similar to FIG. 3 and illustrates a connection post of a load carrier which has been diverted onto the branch line deflecting the seal gap closure plate out of closing relation to the seal gap.
Figure 5:
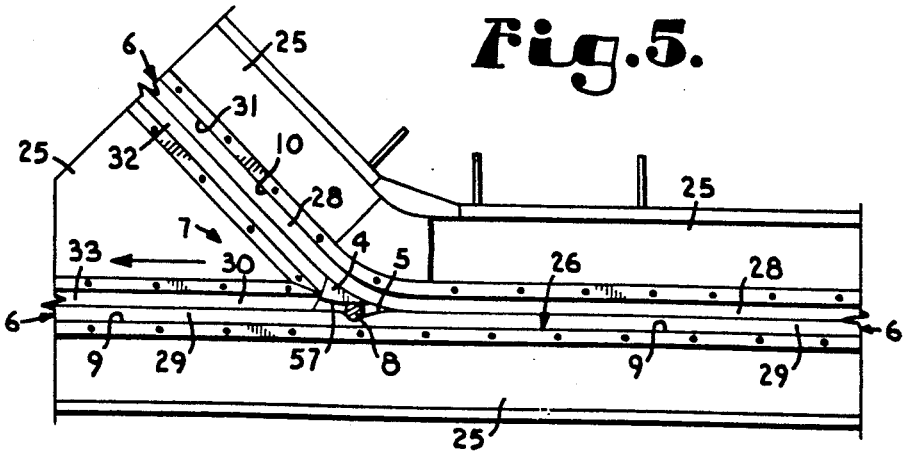
FIG. 5 is a view similar to FIG. 3 and illustrates a connection post of a load carrier which is being maintained on the main line of the conveyor deflecting the seal gap closure plate out of closing relation to the seal gap.

Inverted power and free conveyors, such as the system 2, are provided with branch tracks or lines 10 off the main track or line 9 to selectively divert load carriers 23 to off line stations for temporary storage, further processing and assembly, and the like. The terms "main" line and "branch" line as used herein are relative terms. Generally, a main line 9 is a relatively straight section of the conveyor system 2 off which other lines branch. Relatively speaking, any given branch line 10 may also be a main line to lines branching from it. The branch lines 10 not only diverge from the main line 9 but may also merge or converge back into the main line 9. The branch line 10 may be powered in a manner similar to the main line 9 with a branch power chain (not shown) or may be unpowered. The branch line 10 is constructed in a manner similar to the main line and is covered by the plates 25 which form an elongated branch slot or opening 31 therebetween. The branch slot 31 is closed by the seal system 6 which, as illustrated in FIGS. 3-5, includes a continuation of the seal member 28 diverging from the seal 29 in the main slot 30 and an inner seal member 32 on an inner side of the branch slot 31 relative to the switch junction 7. The main slot 30 is provided with an inner seal member 33 which closes it past the junction 7.

The seal gap 5 is formed between the tangent point of divergence of the seals 28 and 29 and the beginning of the inner seals 32 and 33. While it would be possible to extend portions of the inner seals 32 and 33 to close the seal gap 5, such extensions (not shown) would be pointed in a direction against the direction of the oncoming connection posts 8. In a short time, such extensions would be damaged along with portions of the seals 32 and 33 by engagement of the connection posts 8 therewith. Additionally, such extensions would be relatively more flexible than the main portions of the seals 28, 29, 32, and 33 because of their unsupported lengths thereby increasing the likelihood that a worker's foot might penetrate the area of the seal gap 5 and become wedged there.

The present invention provides an apparatus for normally closing the seal gap 5 and for accommodating movement of the load carriers 23 and their connection posts 8 past the closure member 4 either to remain on the main line 9 or to be transferred from the main line 9 to the branch line 10. Because of the location of the seal gap 5 relative to the diverging lines 9 and 10, the closure plate 4 must be mounted in such a manner as to yield in at least two opposite directions in response to engagement by the connection pins 8 in moving along either the main line 9 or the branch line 10. Additionally, it is desirable for the closure plate 4 to return to its neutral position closing the seal gap 5 once a connection post 8 has moved past.

Figure 2:
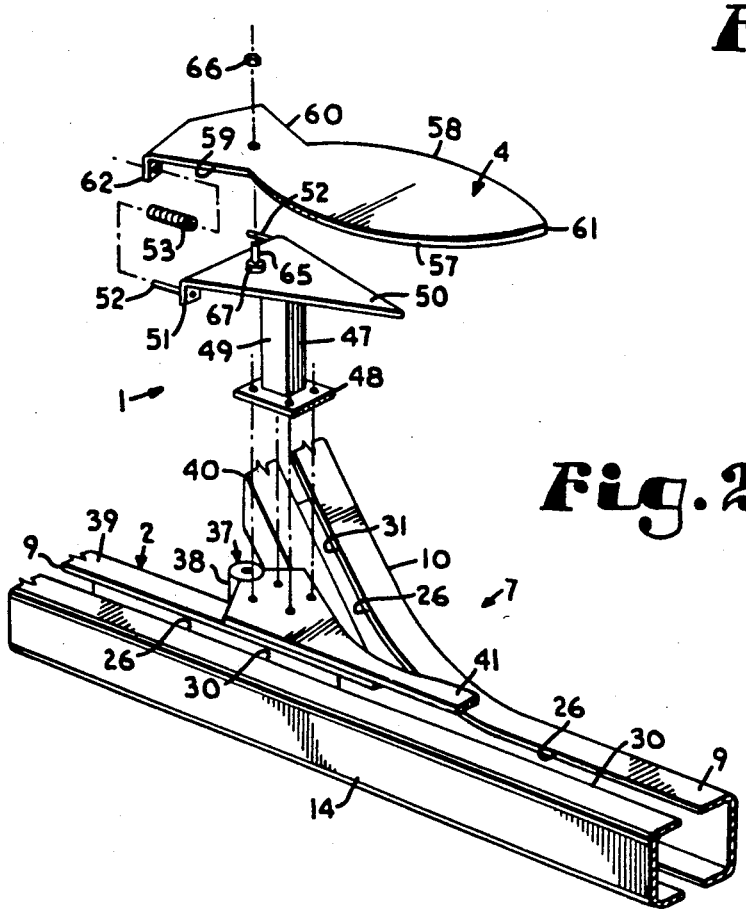
FIG. 2 is a fragmentary exploded perspective view illustrating the principal components of the seal gap closure arrangement.

The illustrated conveyor junction 7 is provided with a switch mechanism 37 which is pivotable to a main position to maintain the load carriers 23 on the main line 9 (FIGS. 8 and 9) or to a branch position to switch the carriers 23 onto the branch line 10 (FIGS. 6 and 7). Referring to FIGS. 1 and 2, the switch mechanism 37 includes a pivot assembly 38 connected to inner channels 39 and 40 forming the power tracks respectively of the main line 9 and the branch line 10 at the junction 7. Upper and lower switch tongues 41 and 42 extend radially from the pivot assembly 38 and are positioned respectively above and below the track members 39 and 40. A lever arm 43 (FIGS. 6–9) extends radially from the pivot assembly 38 on an opposite side from the switch tongues 41 and 42. A linear motor 44, such as a pneumatic cylinder, is pivotally connected between one of the power track members, such as track member 39, and the lever arm 43. When the cylinder 44 is retracted (FIGS. 8 and 9), the switch tongues 41 and 42 are placed in the main position whereby the load carriers 23 remain on the main line 9. When the cylinder 44 is extended, the switch tongues 41 and 42 are pivoted to the branch position (FIGS. 6 and 7), and the oncoming carriers 23 are switched off onto the branch line 10 by engagement of the load trolleys 21 with the switch tongues 41 and 42.

Referring to FIGS. 1, 2, and 10, the closure plate 4 is positioned just below the members of the seal system 6. The illustrated plate 4 is mounted on the upper switch tongue 41 by a closure plate bracket 47. The bracket 47 includes a lower mounting flange 48 with a standard 49 projecting upwardly therefrom. An upper bracket plate 50 is affixed to the top of the standard 49. The bracket plate 50 is triangular in shape and has a pair of downwardly extending tabs 51 at the base thereof. Each of the tabs 51 has a guide rod 52 attached thereto and extending rearwardly therefrom. Compression springs 53 are sleeved onto the rods 52. The bracket 47 is attached to the upper switch tongue 41, as by the passage of fasteners 54 through the mounting flange 48.

The illustrated closure plate 4 has a somewhat fishlike shape, as viewed in plan (FIG. 10), formed by arcuate opposite main and branch deflecting surfaces 57 and 58 respectively and straight main and branch return cam surfaces 59 and 60 respectively. The deflecting cam surfaces 57 and 58 converge to a front point 61, while the return cam surfaces 59 and 60 diverge respectively from the deflecting surfaces 57 and 58. A rear end of the plate 4 has a pair of tabs 62 extending downwardly therefrom. Each tab 62 has a horizontally elongated slot 63 therethrough. The closure plate 4 is pivotally connected to the bracket plate 50 near a rear end thereof, as by a bolt 65 and nut 66, and separated from the bracket plate 50 by a washer 67. The closure plate 4 is positioned on the bracket plate 50 in such a manner that the spring guide rods 52 extend through the slots 63 in the tabs 62 and such that the springs 53 are compressed between the sets of tabs 51 and 62. The springs 53 urge the closure plate 4 to a neutral position relative to the bracket plate 50.

The closure plate is preferably formed of metal sheet stock, such as steel, of a thickness appropriate for supporting several hundred pounds in the area of possible contact without substantial deformation. The closure plate 4 is reinforced to some extent by the bracket plate 50 positioned therebelow. While the closure plate 4 is capable of supporting the weight of a worker or mobile equipment which would be supported on small wheels, it would be more prudent plant practice to train personnel to normally avoid stepping or rolling equipment directly on or over the seal gap 5 and closure plate 4.

When the switch mechanism 37 is in the branch position (FIGS. 6 and 7) to switch load carriers 23 onto the branch line 10 of the conveyor 2, the front point 61 of the closure plate 4 is positioned on the outer or opposite side of the main track center line from the branch line 10 which presents the branch deflecting cam surface 58 of the closure plate 4 to oncoming connection posts 8. Until deflected by a connection post 8, the closure plate 4 is urged to its neutral position (FIG. 3) covering or closing the seal gap 5 by the springs 53. When a connection post 8 approaches the seal gap 5, the post 8 engages the deflecting surface 58 and deflects the closure plate 4 relative to the bracket plate 50 to continue past the seal gap 5. When the connection post 8 has moved a short distance past the seal gap 5, it engages the branch return cam surface 60 which positively returns the closure plate 4 to its neutral position closing the seal gap 5.

Similarly, when the switch mechanism 37 is in its main position (FIGS. 8 and 9) to maintain load carriers 23 on the main line 9, the front point 61 is on the branch side of the main track center line, and the main deflecting cam surface 57 is positioned for engagement by an oncoming connection post 8. Engagement of the post 8 with the main deflecting surface 57 deflects the closure plate 4 relative to the bracket plate 50, and engagement of the post 8 with the main return cam surface 59 positively returns the closure plate 4 to its neutral position.

The seal gap closure arrangement 1 has been described and illustrated as adapted for closing a seal gap 5 occurring at a junction 7 at which a branch conveyor line 10 diverges from a main conveyor line 9. Although not specifically described and illustrated herein, the present invention is also intended to encompass an adaptation of the seal gap closure arrangement 1 for closing a seal gap occurring among seal members at a junction at which a branch line merges back into a main line.

It is to be understood that while certain forms of the present invention have been illustrated and described herein, it is not to be limited to the specific forms or arrangement of parts described and shown.

What is claimed and desired to be secured by Letters Patent is as follows:

1. A seal gap closure for a conveyor including a main line and a branch line connected with said main line, load trolley means supported below a floor level, a load carrier positioned above said floor level, a carrier support member connected between said trolley means and said carrier, seal means comprising components positioned at said floor level and normally closing elongated openings above said main line and said branch line and resiliently separable to permit passage of said support member therealong, and a seal gap occurring among said components of said seal means at a junction of said main line and said branch line, switch means located proximates said junction said seal gap closure comprising:

(a) a seal gap closure member spaced from said switch means and positioned in normally closing relation to said seal gap; and (b) means permitting said closure member to yield in response to engagement by said support member, allowing movement of said support member therepast.

2. An inverted power and free conveyor comprising:

(a) a conveyor track positioned below a floor level and including a main track and at least one branch track diverging from said main track at a switch junction switch means located proximate said junction;
(b) a load trolley supported on said tracks and movable therealong;
(c) a load carrier supported above said floor level by pin means connected to said trolley;
(d) seal means comprising components positioned at said floor level, normally closing elongated openings above said tracks, and resiliently separable by said pin means to permit passage of said pin means therealong;
(e) a seal gap among said components of said seal means at said switch junction;
(f) a seal gap closure member spaced from said switch means and positioned in normally closing relation to said seal gap; and
(g) means permitting said closure member to yield in response to engagement by said pin means, allowing movement of said pin means therepast.

3. An inverted power and free conveyor comprising:
(a) a conveyor track positioned below a floor level and including a main track and at least one branch track diverging from said main track at a switch junction;
(b) a load trolley supported on said tracks;
(c) a load carrier supported above said floor level by pin means connected to said trolley;
(d) seal means closing elongated openings above said track and resiliently separable by said pin means upon passage of said pin means therealong;
(e) a switch mechanism including a switch member positioned below said floor level at said switch junction and selectively movable between a main position to allow said trolley to remain on said main track and a branch position to switch said trolley to said branch track;
(f) a seal gap among components of said seal means above said switch member at said switch junction; and
(g) a seal gap closure member resiliently connected to said switch member, positioned in lower closing relation to said seal gap, and yielding in response to engagement by said pin means to allow movement of said pin means therepast.

4. A conveyor as set forth in claim 3 and including:
(a) conveyor frame means;
(b) said switch member being pivotally mounted on said conveyor frame means;
(c) bracket means connected to said switch member and extending thereabove;
(d) said closure member being pivotally connected to said bracket means; and
(e) resilient means connecting said closure member to said bracket means whereby said pin means urges said closure member out of closing relation to said seal gap to permit said pin means to move therepast and said resilient means urges said closure member back into said closing relation to said gap upon movement of said pin means therepast.

5. A conveyor as set forth in claim 3 wherein said closure member includes:
(a) a main deflecting cam surface engageable by said pin means in said main position of said switch member to urge said closure member out of closing relation to said gap to allow passage of said pin means through said gap in movement along said main track;
(b) a branch deflecting cam surface engageable by said pin means in said branch position of said switch member to urge said closure member out of closing relation to said gap to allow passage of said pin means through said gap upon switching of said carrier onto said branch track;
(c) a main return cam surface engageable by said pin means in said main position of said switch member to positively urge said closure member back into closing relation to said gap upon movement of said pin means past said gap; and
(d) a branch return cam surface engageable by said pin means in said branch position of said switch member to positively urge said closure member back into closing relation to said gap upon movement of said pin means past said gap.

6. A closure as set forth in claim 5 wherein:
(a) said deflecting cam surfaces of said closure member are arcuate similar to upper and lower peripheral surfaces of the body of a fish; and
(b) said return cam surfaces diverge angularly from said deflecting cam surfaces similar to upper and lower peripheral surfaces of the tail of a fish.

7. In an inverted power and free conveyor including a track positioned below a floor level and supporting load trolley means movable along said track, a load carrier supported above said floor level by pin means connected to said load trolley means, seal means closing an elongated opening above said track and separable by said pin means, and a switch mechanism including a switch member positioned below said floor level and selectively movable between a main position and a branch position to switch said load carrier between a main track and at least one branch track, and a seal gap occurring among components of said seal means above said switch member where said branch track connects with said main track, the improvement comprising:
(a) bracket means connected to said switch member and extending thereabove;
(b) a switch gap closure member connected to said bracket means and positioned in lower closing relation to said seal gap; and
(c) resilient means connecting said closure member to said bracket means whereby said pin means urges said closure member out of closing relation to said seal gap to permit said pin means to move therepast and said resilient means urges said closure member back into said closing relation to said gap upon movement of said pin means therepast.

8. A seal gap closure for a conveyor including a main line and a branch line connected with said main line, load trolley mains supported below a floor level, a load carrier positioned above said floor level, a carrier support member connected between said trolley means and said carrier, a switch member selectively pivotable between a main position to maintain said carrier on said main line and a branch position to switch said carrier onto said branch line, seal means positioned at said floor level and normally closing elongated openings above said main line and said branch line a d resiliently separable to permit passage of said support member therealong, and a seal gap occurring among components of said seal means at a junction of said main line and said branch line, said seal gap closure comprising:

(a) a seal gap closure member mounted on said switch member and positioned in normally closing relation to said seal gap; and (b) means permitting said closure member to yield in response to engagement by said support member, allowing movement of said support member therepast.

9. A closure as set forth in claim 9

(a) said closure member is resiliently mounted on said switch member.

10. A closure as set forth in claim 9 wherein said closure member includes:

(a) a main deflecting cam surface engageable by said support member in said main position of said switch member to urge said closure member out of closing relation to said gap to allow passage of said support member through said gap in movement along said main line; and (b) a branch deflecting cam surface engageable by said support member in said branch position of said switch member to urge said closure member out of closing relation to said gap to allow passage of said support member through said gap upon switching of said carrier onto said branch line.

11. A closure as set forth in claim 10 wherein said closure member includes:

(a) a main return cam surface engageable by said support member in said main position of said switch member to positively urge said closure member back into closing relation to said gap upon movement of said support member past said gap; and (b) a branch return cam surface engageable by said support member in said branch position of said switch member to positively urge said closure member back into closing relation to said gap upon movement of said support member past said gap.

12. A closure as set forth in claim 11 wherein:

(a) said closure member is planar and has a plan form generally similar to the periphery of a fish.

13. A closure as set forth in claim 11 wherein:

(a) said deflecting cam surfaces of said closure member are arcuate similar to upper and lower peripheral surfaces of the body of a fish; and (b) said return cam surfaces diverge angularly from said deflecting cam surfaces similar to upper and lower peripheral surfaces of the tail of a fish.

14. A closure as set forth in claim 8 wherein:

(a) said closure member is positioned immediately below said components of said seal means and in lower closing relation to said gap.

15. An inverted power and free conveyor comprising:

(a) a conveyor track positioned below a floor level and including a main track and at least one branch track diverging from said main track at a switch junction;

(b) conveyor frame means;

(c) a switch member pivotally mounted on said conveyor frame means to switch between a main position to maintain said carrier on said main track and a branch position to switch said carrier onto said branch track;

(d) bracket means connected to said switch member and extending thereabove;

(e) a load trolley supported on said tracks and movable therealong;

(f) a load carrier supported above said floor level by pin means connected to said trolley;

(g) seal means positioned at said floor level, normally closing elongated openings above said tracks, and resiliently separable by said pin means to permit passage of said pin means therealong;

(h) a seal gap among components of said seal means at said switch junction;

(i) a seal gap closure member positioned in normally closing relation to said seal gap; and (j) means permitting said closure member to yield in response to engagement by said pin means, allowing movement of said pin means therepast, and including:

(1) said closure member being pivotally connected to said bracket means; and (2) resilient means connecting said closure member to said bracket means whereby said pin means urges said closure member out of closing elation to said seal gap to permit said pin means to move therepast and said resilient means urges said closure member back into said closing relation to said gap upon movement of said pin means therepast.

16. A conveyor as set forth in claim 15 and including:

(a) a switch mechanism positioned at said switch junction and including said switch member which is selectively pivotable between said main position to maintain said carrier on said main track and said branch position to switch said carrier onto said branch track; and (b) said closure member being resiliently mounted on said switch member.

17. A conveyor as set forth in claim 16 wherein said closure member includes:

(a) a main deflecting cam surface engageable by said pin means in said main position of said switch member to urge said closure member out of closing relation to said gap to allow passage of said pin means through said gap in movement along said main track; and (b) a branch deflecting cam surface engageable by said pin means in said branch position of said switch member to urge said closure member out of closing relation to said gap to allow passage of said pin means through said gap upon switching of said carrier onto said branch track.

18. A closure as set forth in claim 17 wherein said closure member includes:

(a) a main return cam surface engageable by said pin means in said main position of said switch member to positively urge said closure member tack into closing relation to said gap upon movement of said pin means past said gap; and (b) a branch return cam surface engageable by said pin means in said branch position of said switch member to positively urge said closure member back into closing relation to said gap upon movement of said pin means past said gap.

19. A closure as set forth in claim 18 wherein:

(a) said deflecting cam surfaces of said closure member are arcuate similar to upper and lower peripheral surfaces of the body of a fish; and (b) said return cam surfaces diverge angularly from said deflecting cam surfaces similar to upper and lower peripheral surfaces of the tail of a fish.

20. A closure as set forth in claim 15 wherein:

(a) said closure member is positioned immediately below said components of said seal means and in lower closing relation to said gap.

* * * * *